US006827334B2

(12) United States Patent
Volle et al.

(10) Patent No.: US 6,827,334 B2
(45) Date of Patent: Dec. 7, 2004

(54) LIFTING ARRANGEMENT FOR OVERHEAD TRAVELING CRANES

(75) Inventors: Gary E. Volle, Wauwatosa, WI (US); Ross C. Smith, Shorewood, WI (US); Stephen J. McCormick, Shorewood, WI (US)

(73) Assignee: MHE Technologies, Inc., Wilmington, DE (US)

( * ) Notice: Subject to any disclaimer, the term of this patent is extended or adjusted under 35 U.S.C. 154(b) by 0 days.

(21) Appl. No.: 10/319,142

(22) Filed: Dec. 13, 2002

(65) Prior Publication Data

US 2003/0111651 A1 Jun. 19, 2003

Related U.S. Application Data

(60) Provisional application No. 60/340,164, filed on Dec. 14, 2001.

(51) Int. Cl.[7] ..... B66D 1/36

(52) U.S. Cl. ..... 254/285; 254/338; 254/293; 212/274

(58) Field of Search ..... 254/278, 285, 254/338, 266, 293, 292, 316; 212/274

(56) References Cited

U.S. PATENT DOCUMENTS

| | | | | |
|---|---|---|---|---|
| 505,065 A | | 9/1893 | Shaw | |
| 1,741,315 A | | 12/1929 | Kendall | |
| 2,254,910 A | * | 9/1941 | Richards et al. | 254/272 |
| 2,994,513 A | * | 8/1961 | Bowerman et al. | 254/337 |
| 3,854,592 A | * | 12/1974 | Mordre | 212/226 |
| 4,002,321 A | | 1/1977 | Shaw et al. | |
| 4,144,974 A | | 3/1979 | Longthorpe | |
| 4,214,664 A | | 7/1980 | Polen | |
| 4,251,059 A | * | 2/1981 | Fougea | 254/338 |
| 4,360,112 A | | 11/1982 | Brewer et al. | |
| 4,360,304 A | | 11/1982 | Brewer et al. | |
| 5,074,528 A | | 12/1991 | Long, Jr. | |
| 5,167,401 A | | 12/1992 | James et al. | |
| 5,603,420 A | | 2/1997 | Swanson | |
| 5,992,730 A | | 11/1999 | McGuire | |
| 6,023,862 A | * | 2/2000 | Sirjola | 37/397 |
| 6,595,494 B1 | * | 7/2003 | Roodenburg et al. | 254/277 |

* cited by examiner

*Primary Examiner*—Emmanuel Marcelo
(74) *Attorney, Agent, or Firm*—Michael Best & Friedrich LLP

(57) ABSTRACT

A lifting arrangement for overhead traveling cranes. The lifting arrangement includes two single reeved drums that are reeved together to provide true vertical lift of a load. The lifting arrangement allows for equalization of full up and full down rope fleet angles through utilization of axially staggered dual drums and/or a bottom block with two separate sheave nests. The lifting arrangement may utilize commercially available components to reduce the overall cost of the crane when compared with other powerhouse crane designs.

19 Claims, 5 Drawing Sheets

LIFTING ARRANGEMENT FOR OVERHEAD TRAVELING CRANES

This application claims the benefit of prior filed provisional patent application No. 60/340,164 filed on Dec. 14, 2001.

BACKGROUND OF THE INVENTION

The invention relates to overhead traveling cranes, and more particularly, to a lifting arrangement for overhead traveling cranes.

Powerhouse or class "A" overhead traveling cranes are generally utilized for maintenance of power producing equipment, such as generators and turbines. The number of lifts a powerhouse crane performs over its life span is very small, however, the capacity and lift height of the lifts that are performed are extreme. Because the duty cycle of the crane is very low, the lift speeds tend to be slow, especially when the load is heavy. The work done by the crane requires very good control and spotting ability to ensure proper procedure. True vertical lift is also required for ease of assembly of very large machine parts and assemblies.

A powerhouse crane typically includes a long, large diameter drum that is selectively rotated by a motor. The drum is coupled to the motor by a large, high ratio gearbox. A rope wound around the drum winds on to and off of the drum in response to rotation of the drum in opposite directions. Typically, the rope is wire rope and the drum has a double helical groove in which the rope is double reeved as the rope winds on to the drum. A bottom block is supported by the rope such that the bottom block moves up and down as the rope winds on to and off of the drum.

SUMMARY OF THE INVENTION

Powerhouse cranes generally include a large amount of rope because of the extreme lift heights and the use of a double reeved rope configuration to provide true vertical lifting. The drum needs to be sized to store this rope. Generally, the length and/or the diameter of the drum can be increased to add rope storing capacity. Both solutions result in separate problems. As the length of the drum is increased, the length of the trolley frame that supports the drum must also be increased. A longer trolley frame experiences greater bending moments, and therefore, the load members of the trolley frame must be increased in size to compensate. As the diameter of the drum is increased, so does the amount of torque which is required to turn the drum. Typically, a larger gearbox is necessary to provide more torque.

The costs associated with providing enlarged drums, gearboxes and trolley frames add significantly to the overall price of the crane. The components often need to be custom designed for each application, thereby resulting in the manufacturing of only a single crane at a time. Use of mass produced components could significantly reduce the overall cost of these cranes.

Accordingly, the invention provides a crane that can utilize mass produced drums, trolley frames and gearboxes. The invention includes the use of two lift trains. Each lift train includes a drum that is single reeved together with the drum of the other lift train. In some embodiments, both lift trains include similarly sized drums, gearboxes and motors where. The components of each lift train are generally smaller than those typically used on powerhouse cranes. Because the costs associated with the components increase exponentially with the size and torque requirements, the cost of two smaller lift trains is less expensive than the cost of a single custom built lift train.

For lifts of a similar height, a lifting arrangement that includes a single reeved drum generally requires half as much rope as a lifting arrangement that includes a double reeved drum. Although the invention utilizes a lifting arrangement that includes a single reeved drum, the overall amount of rope utilized is similar to that of a lifting arrangement that includes a double reeved drum because the invention utilizes two drums that are singly reeved together. However, the use of two drums reduces the amount of rope stored on each drum by half. Accordingly, the length and/or diameter of each drum can be dramatically reduced when compared to the drums typically utilized on powerhouse cranes. When the length of the drum is reduced, the length of the trolley frame is reduced resulting in the ability to use a mass produced trolley frame, such as the trolley frame disclosed in U.S. Pat. No. 5,992,730, which is assigned to the assignee of this application. When the diameter of the drum is reduced, the torque requirements are reduced resulting in the ability to use a smaller mass produced gearbox. A ring gear external to the gearbox may be utilized to increase the torque of a smaller gearbox such that very high ratios (e.g., ratio of 600 to 1) can be achieved with a standard three stage helical gearbox.

Although the cost of components utilized on a powerhouse crane can be reduced as discussed above, the components must provide a lifting arrangement that meets all safety requirements including fleet angle requirements. In one embodiment, the invention provides a lifting arrangement that meets all fleet angle requirements by staggering the axial position of each drum in relation to the other drum. The fleet angles in the full up and full down positions can be equalized by this positional shift between the two drums to optimize the fleet angles and thus maximize rope life. A bottom block with two separate sheave nests can also be utilized to optimize the rope fleet angles. Use of two separate sheave nests allows for optimum placement of the sheave nests with respect to the corresponding drum. Additionally, the width of the bottom block can be increased such that the sheave nests can be placed at any location with respect to the drums. Generally, the sheave nests are located near the ends of the bottom block. In some embodiments, a combination of drum stagger and custom bottom block length are used to ensure proper fleet angles. Adjustment of the drum stagger and bottom block length can be used to solve the fleet angle limitations of a crane including any combination of variables.

As is apparent from the above, the invention provides a lifting arrangement for a crane that includes the use of dual drums single reeved together to provide true vertical lift. The invention also provides a lifting arrangement that includes mass produced components. The mass produced components provide a crane having a smaller footprint and height when compared to previous cranes built for similar applications. The invention also provides a lifting arrangement that allows for equalization of full up and full down rope fleet angles through utilization of axially staggered dual drums and/or an extra wide bottom block with two separate sheave nests. The invention also provides a lifting arrangement that includes commercially available components which reduce the overall cost of the crane when compared with current powerhouse crane designs, while still meeting all powerhouse crane requirements. Other objects of the invention will become apparent to those skilled in the art upon review of the following detailed description and drawings in which like numerals are used to designate like features.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," and "coupled" are used broadly and encompass both direct and indirect mountings, connections, and couplings. Further, "connected" and "coupled" are not restricted to physical or mechanical connections or couplings.

Figure 1:
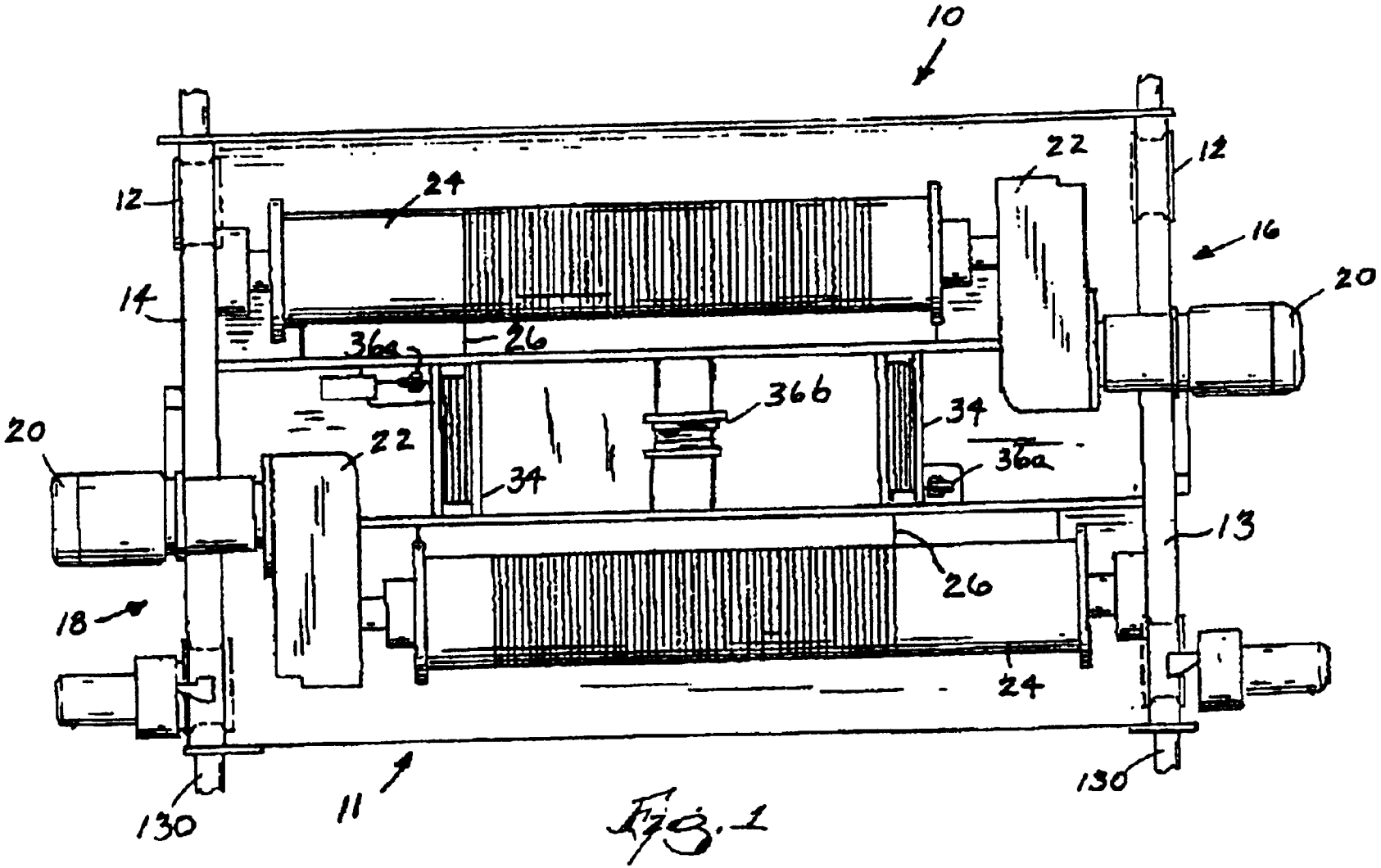
FIG. 1 illustrates a top view of an overhead traveling crane embodying the invention.
Figure 2:
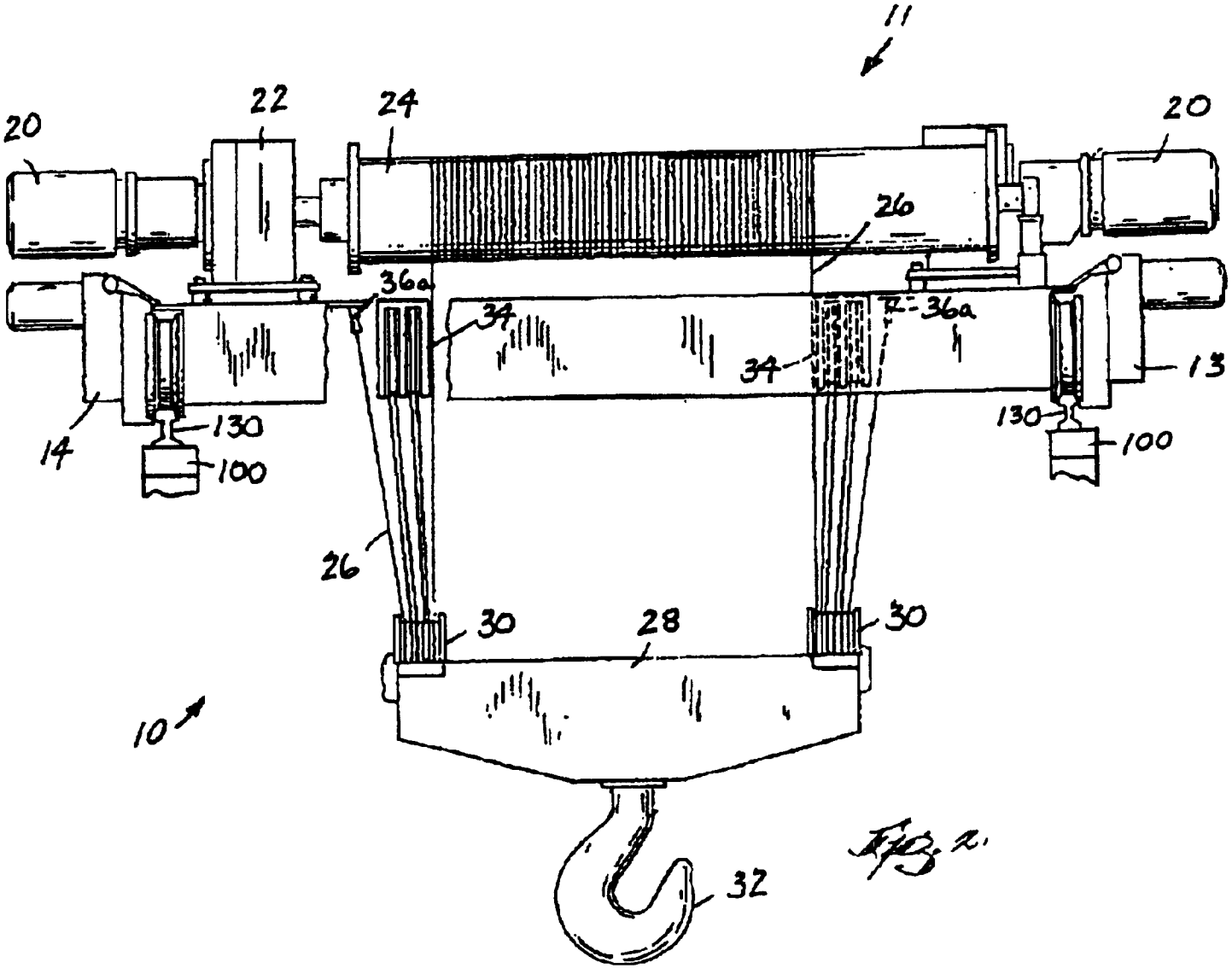
FIG. 2 illustrates a front view of the crane of FIG. 1.
Figure 3:
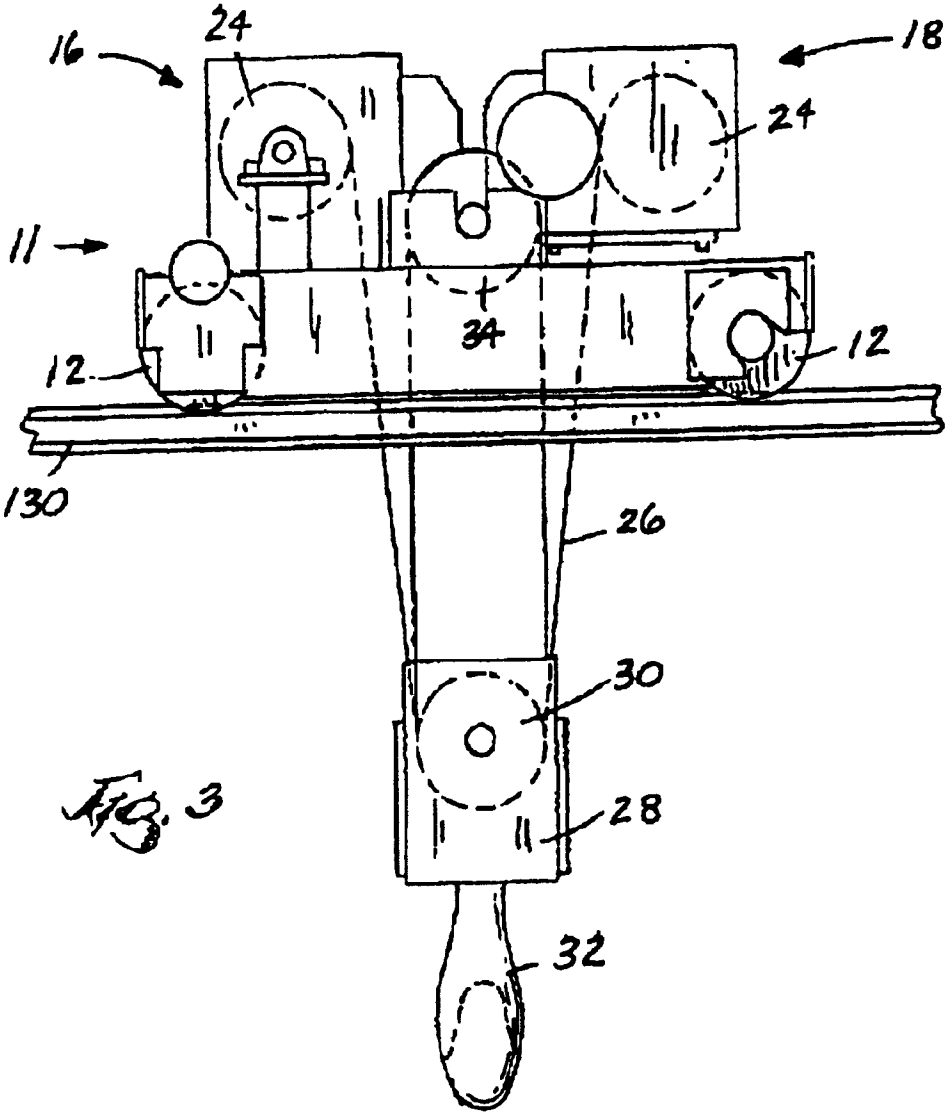
FIG. 3 illustrates a side view of the crane of FIG. 1.

FIGS. 1, 2 and 3 partially illustrate an overhead traveling crane or hoist apparatus 10 embodying the invention. It should be understood that the lifting arrangement of the present invention is capable of use in other lifting devices (e.g., other types of overhead traveling cranes, hoist apparatus, and the like) and the crane 10 is merely shown and described as one such example. The crane 10 is of the type commonly known as powerhouse cranes.

Figure 4:
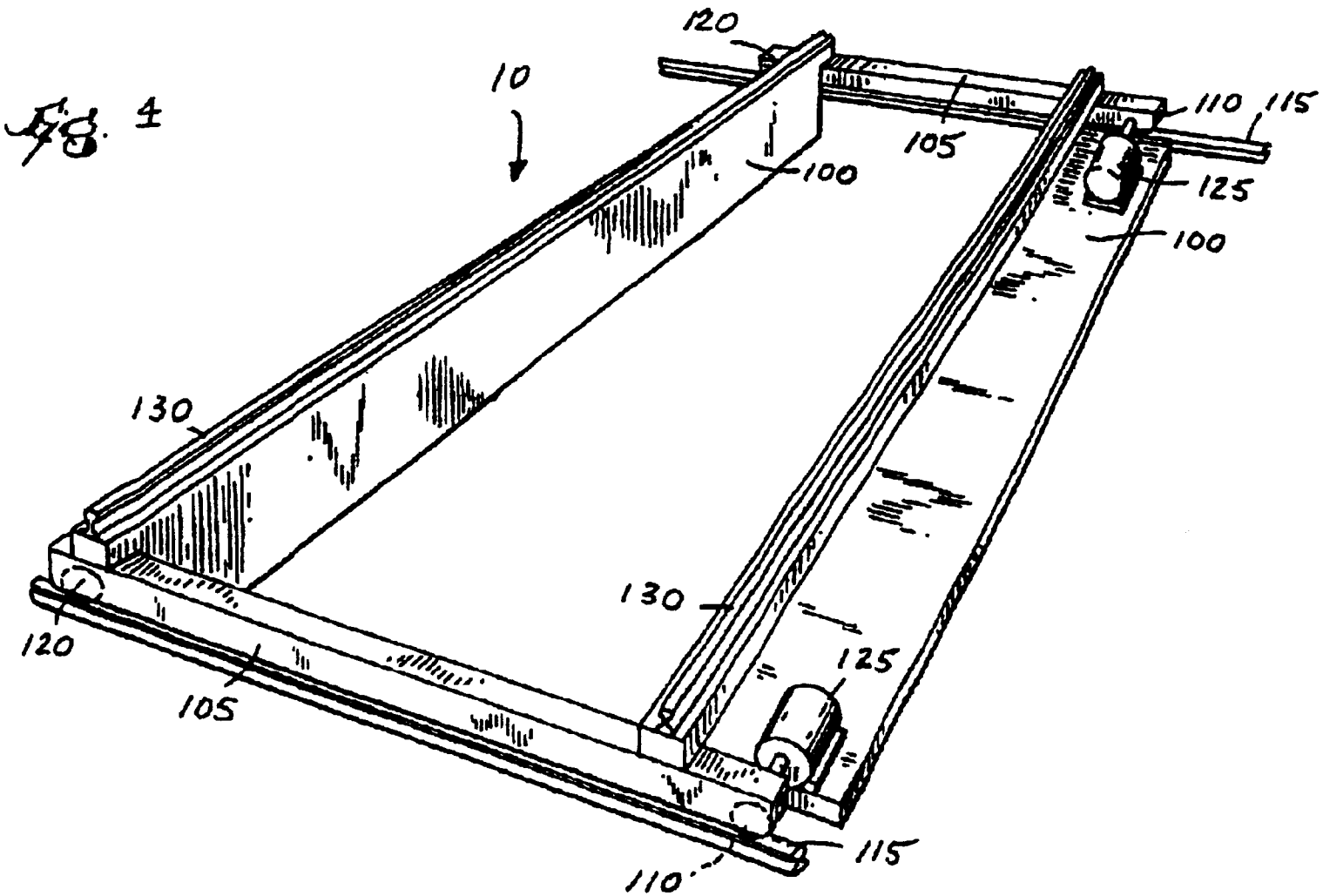
FIG. 4 illustrates a perspective view of a representative set of bridge cross-members and trucks of an overhead traveling crane supported for movement on a set of rails.

The portion of the crane 10 illustrated in FIGS. 1-3 includes a trolley 11. As illustrated in FIG. 4, the crane 10 also includes bridge cross-members 100 and trucks 105 mounted at opposite ends of the bridge cross-members 100. Drive wheels 110 are rotatably mounted on the trucks 105 in engagement with rails 115 so that the rails 115 support the crane 10. Additional non-driven or idler wheels 120 are also rotatably mounted on the trucks 105 in engagement with the rails 115 for further support of the crane 10. The rails 115 are mounted on conventional beams (not shown) or other suitable foundation means. The engagement of the drive and idler wheels 110, 120 with the rails 115 permits travel of the crane 10 along the rails 115. Motors 125 are mounted on the bridge cross-member 100 and drive the wheels 10.

The trolley 11 is supported for travel on tracks or rails 130 by wheel assemblies 12. The rails 130 are mounted on the bridge cross-members 100 of the crane 10.

The trolley 11 includes generally parallel first and second trolley sides 13, 14. The trolley sides 13, 14 support a first lift train 16 and a second lift train 18. Each lift train 16 and 18 includes a motor 20, a gearbox 22 and a drum 24. As illustrated in FIG. 1, the gearbox 22 and the motor 20 of the first lift train 16 are disposed adjacent the first trolley side 13, and the gearbox 22 and the motor 20 of the second lift train 18 are disposed adjacent the second trolley side 14. The drums 24 of the first and second lift train 16 and 18 can be single reeved together using a single rope 26 or a combination of ropes 26. Rope 26 is wound around the drums 24 such that rotation of the drums 24 causes the rope 26 to wind on to and off of the rotated drum 24. A bottom block 28 is supported by the rope 26 such that the bottom block 28 moves up and down as the rope 26 wind on to and off of the drums 24. The bottom block 28 includes two sheave nests 30 and a material handling hook 32 coupled thereto. The sheave nests 28 are generally located at a first and second end of the bottom block 28. Other sheave nests 28 are mounted on the frame of the trolley 11. In one embodiment, the rope 26 is dead ended at points 36*a* adjacent respective sheave nests 28. In another embodiment, an equalizer sheave 36*b* (FIG. 1) is mounted on the frame of the trolley 11 so the rope 26 is reeved through the equalizer sheave 36*b* when transitioning from the first lift train 16 to the second lift train 18.

Figure 5:
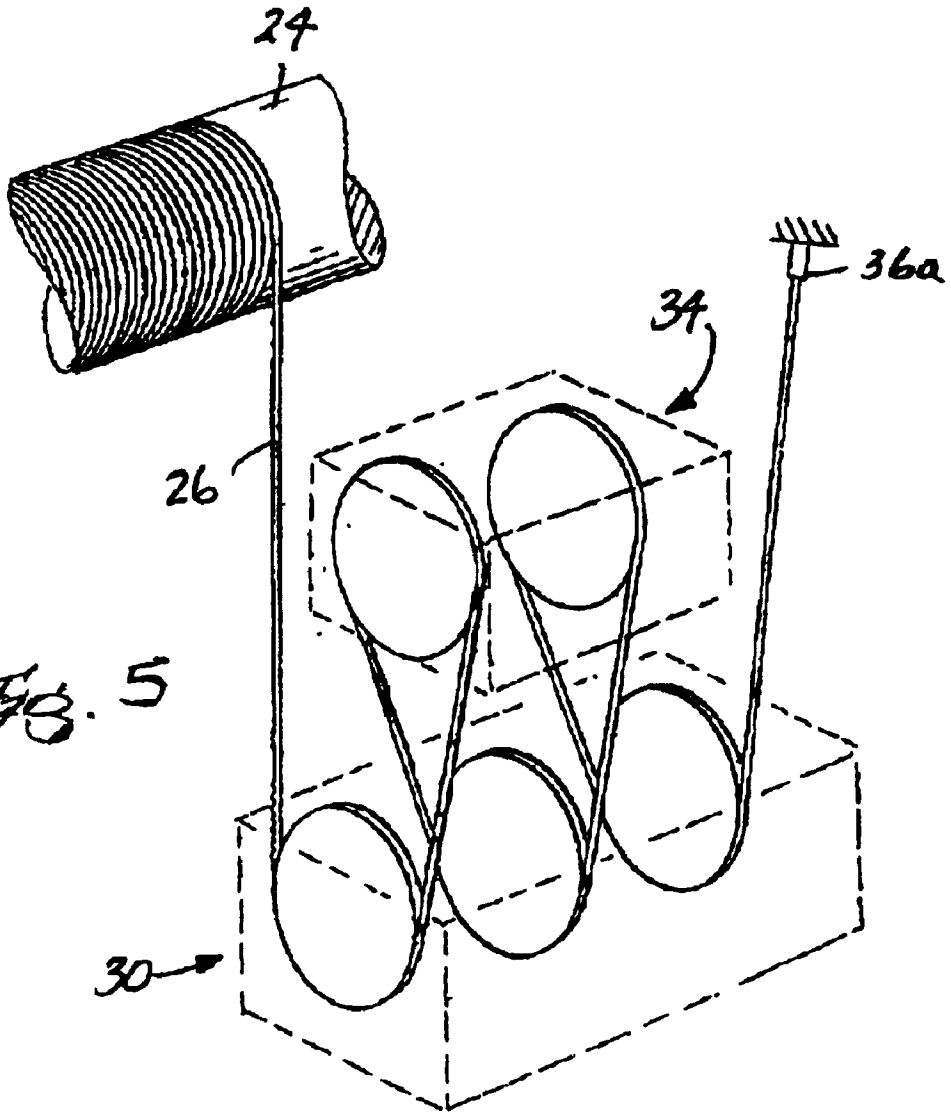
FIG. 5 illustrates a schematic representation of a reeving configuration for the crane of FIG. 1.

FIG. 5 illustrates a reeving configuration for the lifting arrangement. A first end of the rope 26 is fixed to a first end of the drum 24 and then wrapped around the drum 24. The rope 26 may be removably fixed to the drum such that the rope 26 can be adjusted to compensate for differences in the manufactured lengths of rope. Generally, this adjustment is accomplished during reeving of the lifting arrangement.

Referring to FIG. 5, the rope 26 reeves from the drum 24 down around a first sheave of the sheave nest 30, back up around a first sheave of the sheave nest 34, back down around a second sheave of the sheave nest 30, back up around a second sheave of the sheave nest 34, back down around a third sheave of the sheave nest 30, and back up to the dead end 36*a*. The other rope 26 is similarly reeved. Such a reeving configuration requires six parts of rope for each lift train 16 and 18. Other reeving configurations may be utilized that include fewer or more parts of rope.

When establishing the lifting arrangement for a particular crane, the design is primarily based on lift speed requirements and capacity requirement. Other considerations may include lift height requirements and specifications of generally available components (e.g., the diameters and lengths of drums, the outputs of motors, the ratio of gearboxes, and the cost of each). The lifting arrangement takes into account variables such as the overall length of the rope, the number of parts of rope, the diameter of the rope, the gap between wraps of the rope on the drum, the length of the drum, and the diameter of the drum. The size of the drum is determined by calculating the amount of rope that must be stored on the drum. The overall length of the rope is a function of the lift height and the number of parts of rope. A drum is selected that provides storage for the overall length of the rope. The diameter of the rope and the gap between each wrap of rope are utilized with the length and the diameter of the drum to determine if the overall length of the rope can fit on the drum. In some embodiments, the drum is a mass produced item. The motor is selected to meet the capacity and lift speed requirements. The gearbox is selected to drivingly couple the motor to the drum for rotation so the load is lifted at the required speed. In some embodiment, the motor and the gearbox are preferably mass produced items. A standard gearbox can generally be utilized as a stand alone unit or in combination with a ring gear external to the gearbox. Use of a ring gear external to the gearbox can increase the overall output torque of the gearbox. The two lift trains are coupled to a trolley frame, which is preferably mass produced, and the rope is then reeved accordingly to the selected reeve configuration.

The final design of a lifting arrangement may be based on various cost considerations. Balancing is performed between the cost of components and the benefits received from use of those particular components. As an example, a lifting arrangement with a wider diameter, shorter, drum may be more cost effective than a lifting arrangement with a smaller diameter, longer, drum. The final determination is generally which design provides the best crane for the best price in accordance with the requirements of the crane purchaser.

The fleet angles need to be inspected before the crane 10 is operated using the lifting arrangement. If the fleet angles are not within the standard range, the axial position of the drums 24 and/or the placement of the sheave nests 30 on the bottom block 28 must be adjusted. The staggering of the drums 24 can be adjusted such that the fleet angles are equalized in the full up and full down positions. Additionally, the width of the bottom block 28 can be increased to provide such equalization. Adjustment of the drum position can be accomplished while the crane 10 is being assembled. The bottom block 28 can be selected from a number of existing bottom block designs or custom produced if necessary.

Thus, the invention provides, among other things, a new and useful lifting arrangement for a crane.

What is claimed is:

1. A hoist apparatus comprising:

a frame;

a first hoist drum mounted to the frame for rotation about a first drum axis;

a first portion of hoist rope single reeved around the first hoist drum;

a second hoist drum mounted to the frame for rotation about a second drum axis, the second drum axis being spaced from and substantially parallel to the first drum axis;

a second portion of hoist rope single reeved around the second hoist drum; and a device for engaging a load, the device including a main portion, a first sheave mounted to the main portion and rotatable about a sheave axis, and a second sheave mounted to the main portion and rotatable about the sheave axis, the sheave axis being sheaved from and substantially parallel to the first drum axis, the first portion of hoist rope being reeved around the first sheave, and the second portion of hoist rope being reeved around the second sheave, such that rotation of the drums raises and lowers the device, wherein the second hoist drum is axially offset with respect to the first hoist drum.

2. The hoist apparatus of claim 1, wherein the first and second portions of hoist rope are portions of a single, integrally formed rope.

3. The hoist apparatus of claim 2, and further comprising an equalizer sheave mounted to the frame, wherein at least one of the first and second portions of hoist rope is reeved around the equalizer sheave.

4. The hoist apparatus of claim 1, wherein each of the hoist rope portions includes opposite end portions, and wherein one of the end portions of each hoist rope portion is dead ended on the frame.

5. The hoist apparatus of claim 1, and further comprising a first hoist motor drivingly connected to the first hoist drum and a second hoist motor drivingly connected to the second hoist drum.

6. The hoist apparatus of claim 1, wherein the device includes a bottom block and a hook coupled to the bottom block, wherein the first and second sheaves are mounted to the bottom block.

7. The hoist apparatus of claim 1, wherein the hoist apparatus provides substantially true vertical lift of the load.

8. The hoist apparatus of claim 1, and further comprising a third sheave mounted to the frame and rotatable about a second sheave axis, and a fourth sheave mounted to the frame and rotatable about the second sheave axis, the second sheave axis being spaced from and substantially parallel to the first and second drum axes, the first portion of hoist rope being reeved around the third sheave, and the second portion of hoist rope being reeved around the fourth sheave.

9. The hoist apparatus of claim 1, wherein the frame includes a trolley and a first sets of rails, wherein the trolley is supported for movement on the first set of rails, wherein the first set of rails is supported for movement on a second set of rails, and wherein the device is positioned over the load by moving the trolley with respect to the first set of rails and the first set of rails with respect to the second set of rails.

10. A hoist apparatus comprising:

a frame;

a first hoist drum mounted to the frame for rotation about a first drum axis;

a first portion of hoist rope single reeved around the first hoist drum;

a second hoist drum mounted to the frame for rotation about a second drum axis, the second drum axis being spaced from and substantially parallel to the first drum axis;

a second portion of hoist rope single reeved around the second hoist drum; and a device for engaging a load, the device including a main portion, a first sheave mounted to the main portion and rotatable about a sheave axis, and a second sheave mounted to the main portion and rotatable about the sheave axis, the sheave axis being spaced from and substantially parallel to the first drum axis, the first portion of hoist rope being reeved around the first sheave, and the second portion of hoist rope being reeved around the second sheave, such that rotation of the drums raises and lowers the device, wherein the first and second hoist drums each include a first drum end and a second drum end, wherein the second drum end of the first drum is spaced from the first drum end of the first drum in a certain direction, wherein the second drum end of the second drum is spaced from the first drum end of the second drum in the certain direction, wherein the first portion of hoist rope includes an end portion fixedly coupled to the first hoist drum adjacent the first drum end thereof and wherein the second portion of hoist rope includes an end portion fixedly coupled to the second hoist drum adjacent the second drum end thereof.

11. A hoist apparatus that provides substantially true vertical lift of a load, the hoist apparatus comprising:

a frame;

a first hoist drum mounted to the frame for rotation about a first drum axis;

a first hoist motor drivingly connected to the first hoist drum;

a first portion of hoist rope single reeved around the first hoist drum;

a second hoist drum mounted to the frame for rotation about a second drum axis, the second drum axis being spaced from and substantially parallel to the first drum axis;

a second hoist motor drivingly connected to the second hoist drum;

a second portion of hoist rope single reeved around the second hoist drum;

a device for engaging a load, the device including a bottom block having a bottom block and a hook coupled to the bottom block, a first sheave mounted to the bottom block and rotatable about a sheave axis, and a second sheave mounted to the bottom block and rotatable about the sheave axis, the sheave axis being spaced from and substantially parallel to the first and second drum axes, the first portion of hoist rope being reeved around the first sheave, and the second portion of hoist rope being reeved around the second sheave, such that rotation of the drums raises and lowers the device;

a third sheave mounted to the frame and rotatable about a second sheave axis, the second sheave axis being spaced from and substantially parallel to the first and second drum axes, the first portion of hoist rope being reeved around the third sheave; and a fourth sheave mounted to the frame and rotatable about the second sheave axis, the second portion of hoist rope being reeved around the fourth sheave.

12. The hoist apparatus of claim 11, wherein the second hoist drum is axially offset with respect to the first hoist drum.

13. The hoist apparatus of claim 11, and further comprising an equalizer sheave mounted to the frame, wherein at least one of the first and second portions of hoist rope is reeved around the equalizer sheave.

14. The hoist apparatus of claim 11, wherein each of the hoist rope portions includes opposite end portions, and wherein one of the end portions of each hoist rope portion is dead ended on the frame.

15. The hoist apparatus of claim 11, wherein the first and second hoist drums each include a first drum end and a second drum end, wherein the second drum end of the first drum is spaced from the first drum end of the first drum in a certain direction, wherein the second drum end of the second drum is spaced from the first drum end of the second drum in the certain direction, wherein the first portion of hoist rope includes an end portion fixedly coupled to the first hoist drum adjacent the first drum end thereof and wherein the second portion of hoist rope includes an end portion fixedly coupled to the second hoist drum adjacent the second drum end thereof.

16. The hoist apparatus of claim 11, wherein the frame includes a trolley and a first sets of rails, wherein the trolley is supported for movement on the first set of rails, wherein the first set of rails is supported for movement on a second set of rails, and wherein the device is positioned over the load by moving the trolley with respect to the first set of rails and the first set of rails with respect to the second set of rails.

17. A hoist apparatus that provides substantially true vertical lift of a load, the hoist apparatus comprising:

a frame having a trolley and a first sets of rails, the trolley being supported for movement on the first set of rails;

a first hoist drum mounted to the trolley for rotation about a first drum axis, the first hoist drum having a first drum end and a second drum end, the second drum end of the first hoist drum being spaced from the first drum end of the first hoist drum in a certain direction;

a first hoist motor drivingly connected to the first hoist drum;

a first portion of hoist rope single reeved around the first hoist drum, the first portion of hoist rope having an end portion fixedly coupled to the first hoist drum adjacent the first drum end thereof;

a second hoist drum mounted to the trolley for rotation about a second drum axis, the second drum axis being spaced from and substantially parallel to the first drum axis, the second hoist drum being axially offset with respect to the first hoist drum, the second hoist drum having a first drum end and a second drum end, the second drum end of the second hoist drum being spaced from the first drum end of the second hoist drum in the certain direction;

a second hoist motor drivingly connected to the second hoist drum;

a second portion of hoist rope single reeved around the second hoist drum, the second portion of hoist rope having an end portion fixedly coupled to the second hoist drum adjacent the second drum end thereof;

a device for engaging the load, the device including a bottom block and a hook coupled to the bottom block, a first sheave mounted to the bottom block and rotatable about a sheave axis, and a second sheave mounted to the bottom block and rotatable about the sheave axis, the sheave axis being spaced from and substantially parallel to the first and second drum axes, the first portion of hoist rope being reeved around the first sheave, and the second portion of hoist rope being reeved around the second sheave, such that rotation of the drums raises and lowers the device;

a third sheave mounted to the trolley and rotatable about a second sheave axis, the second sheave axis being spaced from and substantially parallel to the first and second drum axes, the first portion of hoist rope being reeved around the third sheave; and a fourth sheave mounted to the trolley and rotatable about the second sheave axis, the second portion of hoist rope being reeved around the fourth sheave.

18. The hoist apparatus of claim 17, and further comprising an equalizer sheave mounted to the trolley, wherein at least one of the first and second portions of hoist rope is reeved around the equalizer sheave.

19. The hoist apparatus of claim 17, wherein each of the hoist rope portions includes an end portion dead ended on the trolley.

* * * * *

UNITED STATES PATENT AND TRADEMARK OFFICE

CERTIFICATE OF CORRECTION

PATENT NO. : 6,827,334 B2 
DATED : December 7, 2004
INVENTOR(S) : Gary E. Volle, Ross C. Smith and Stephen J. McCormick It is certified that error appears in the above-identified patent and that said Letters Patent is hereby corrected as shown below:

Column 5,
Line 34, delete “sheaved”; insert -- spaced --.

Signed and Sealed this

First Day of November, 2005

JON W. DUDAS
*Director of the United States Patent and Trademark Office*